US005580055A

United States Patent [19]

Hagiwara

[11] Patent Number: 5,580,055

[45] Date of Patent: Dec. 3, 1996

[54] AMUSEMENT DEVICE AND SELECTIVELY ENHANCED DISPLAY FOR THE SAME

[75] Inventor: Takashi Hagiwara, Kanagawa-ken, Japan

[73] Assignee: Sigma, Inc., Tokyo, Japan

[21] Appl. No.: 207,984

[22] Filed: Mar. 8, 1994

[30] Foreign Application Priority Data

Mar. 18, 1993 [JP] Japan ..... 5-058721
May 20, 1993 [JP] Japan ..... 5-118510

[51] Int. Cl.[6] ..... G07F 17/34; A63F 5/04

[52] U.S. Cl. ..... 273/143 R; 273/DIG. 24

[58] Field of Search ..... 273/143 R, 143 A, 273/143 B, 142 A, 138 A; 463/16, 20

[56] References Cited

U.S. PATENT DOCUMENTS

| | | | |
|---|---|---|---|
| 4,198,147 | 4/1980 | Alasia | 354/115 |
| 4,584,604 | 4/1986 | Guichard et al. | 358/92 |
| 4,711,452 | 12/1987 | Dickinson et al. | 273/143 R |
| 5,152,529 | 10/1992 | Okada | 273/143 R |
| 5,284,344 | 2/1994 | Howard | 273/143 R |

FOREIGN PATENT DOCUMENTS

| | | | |
|---|---|---|---|
| 2921159A1 | 12/1980 | Germany . | |
| 61-151785 | 9/1986 | Japan . | |
| 62-27689 | 2/1987 | Japan . | |
| 3-58476 | 6/1991 | Japan . | |
| 3-58475 | 6/1991 | Japan . | |
| 4090777 | 3/1992 | Japan | 273/138 A |
| 4-50089 | 4/1992 | Japan . | |
| 4-50090 | 4/1992 | Japan . | |
| 4108468 | 4/1992 | Japan | 273/143 R |
| 4161182 | 6/1992 | Japan | 273/143 R |
| 4-208176A | 7/1992 | Japan . | |
| 4-220276A | 8/1992 | Japan . | |
| 6-98964 | 4/1994 | Japan . | |
| 2089086 | 6/1982 | United Kingdom | 273/143 R |
| 2092795 | 8/1982 | United Kingdom | 273/143 R |
| 2116345 | 9/1983 | United Kingdom . | |
| 2145266 | 3/1985 | United Kingdom | 273/143 R |
| 2156565 | 10/1985 | United Kingdom | 273/143 R |
| 2165074 | 4/1986 | United Kingdom | 273/143 R |
| 2165387 | 4/1986 | United Kingdom . | |
| 2194093 | 2/1988 | United Kingdom . | |
| 2233806 | 1/1991 | United Kingdom | 273/138 A |
| 2253299 | 9/1992 | United Kingdom | 273/138 A |
| 930005484 | 3/1993 | WIPO | 273/143 B |

OTHER PUBLICATIONS

Takanori Okoshi, "Three–Dimensional Imaging Techniques," Academic Press 1976, pp. 4–5, 12–29 and 70–71.

*Primary Examiner*—Jessica Harrison
*Attorney, Agent, or Firm*—Skjerven, Morrill, MacPherson, Franklin & Friel; Brian D. Ogonowsky; William L. Paradice, III

[57] ABSTRACT

The intensity and enjoyment of a gaming device with a rotary body structure containing one or more symbol-carrying rotary reels is enhanced by selectively highlighting special symbols on the rotary reels in unique ways. The selective highlighting of these special symbols is achieved in ways including the use of phosphorescent, fluorescent, or otherwise luminescent symbols, the use of stereoscopically processed symbols to achieve three-dimensional effects, the use of stereoscopic symbols to achieve animation effects, the use of selective backlighting for the special symbols, and the use of special control means for the selective backlighting of the symbols.

9 Claims, 14 Drawing Sheets

Fig. 16

| MODE | OPERATION | LIGHT SOURCE #1 | LIGHT SOURCE #2 |
|---|---|---|---|
| 1 | ROTATING | ON | OFF |
| | STOPPED | OFF | ON |
| 2 | ROTATING | OFF | ON |
| | STOPPED | ON | ON |
| 3 | ROTATING | ON | OFF |
| | STOPPED | OFF | FLASH |
| 4 | ROTATING | ON | ON |
| | STOPPED | OFF | FLASH |
| 5 | ROTATING | FLASH | OFF |
| | STOPPED | OFF | FLASH |
| 6 | ROTATING | OFF | FLASH |
| | STOPPED | FLASH | FLASH |

AMUSEMENT DEVICE AND SELECTIVELY ENHANCED DISPLAY FOR THE SAME

FIELD OF THE INVENTION

This invention relates to amusement devices, and in particular to machines which are equipped with one or more rotary reels containing symbols arranged on their outer peripheral surfaces.

BACKGROUND OF THE INVENTION

A typical gaming device, such as a slot machine, has one or more rotary reels, each rotary reel having around its periphery a tape displaying one or more symbols. A player operates the gaming device, causing these rotary reels to be rotated and stopped. A win is determined based on whether the symbols are aligned on predetermined prize-winning lines when these rotary reels are stopped. The number of coins to be paid to the player is varied in accordance with the kind of aligned symbols.

For example, ten coins would be paid if the aligned symbols are "BAR" symbols, and one hundred coins would be paid for the alignment of "7" symbols. After pulling a lever or pressing a start button for a slot machine, or after pressing a stop button on a slot-and-pinball machine, a player will focus his attention on the symbols arriving at the display window, desiring that alignment of symbols corresponding to a larger number of winning coins will appear. The different winnings for alignments of the different symbols enhance the amusement and excitement provided by the game.

In view of the attention given by players to the aligned symbols during play, there have been proposed slot machines in which an illuminator is placed behind the rotary reels in the vicinity of the display window, with a purpose to illuminate only the symbols in the vicinity of the display window or to otherwise adorn the symbols (see U.S. Pat. No. 4,711,452, Japanese Laid-open Patent Application No. 4-208176, Japanese Laid-open Patent Application No. 4-220276, Japanese Laid-open Utility Model Application No. 3-58476, Japanese Laid-open Utility Model Application No. 4-50090, Japanese Laid-open Utility Model Application No. 4-50089, Japanese Laid-open Utility Model Application No. 3-58475, and Japanese Laid-open Utility Model Application No. 61151785). By illuminating or embossing the symbols appearing in the display window they are made more conspicuous.

In these machines, the symbols appearing in the display window are made more conspicuous than those in the conventional machine. However, all kinds of symbols appearing in the display window are made conspicuous to the same degree, so that there is no effect of intensifying or exciting the player's expectations for specific symbols for which high winning is made.

As described above, the player hopes for the appearance of symbols for which a high winning is paid (e.g., "7"), and in particular the player is likely to concentrate on these specific symbols immediately before the reels are stopped. The player's interest and suspense would be magnified, and the amusement of the game improved, by making these specific symbols more conspicuous.

SUMMARY OF THE INVENTION

In view of the above, the object of the present invention is to intensify a player's expectations and improve the amusement of the gaming device by enhancing the visual impact of specific symbols contained on its rotary reels. In accordance with the present invention, a gaming device equipped with one or more rotary reels is characterized, whereby at least one of the rotary reels includes on its periphery at least one luminescent symbol, and whereby a light-emitting source is disposed adjacently to the peripheral surface of the rotary reel and serves to supply light energy to the luminescent symbol. The luminescent symbol may comprise a phosphorescent material, which absorbs light from the light source and emits light for a period of time. The luminescent symbol may also comprise a fluorescent or otherwise luminescent material.

Further, a gaming device equipped with one or more rotary reels is characterized, whereby at least one of the rotary reels includes at least one stereoscopic image symbol. The stereoscopic image symbol comprises a stereoscopically processed composite picture which is obtained by compositing plural images which together achieve a parallax, or which together achieve an animation effect. The stereoscopic image symbol further comprises a well known lenticular sheet which stereoscopically displays the stereoscopically processed composite picture. The lenticular sheet may be placed directly on the surface of the rotary reel where the stereoscopically processed composite picture lies, or may be placed adjacent to the surface of the rotary reel between a display window and the surface of the rotary reel.

Still further, a gaming device equipped with one or more rotary reels is characterized, whereby at least one of the rotary reels is a light-transmissible rotary reel comprising one or more symbols on its periphery and a light-shielding mask means on its periphery, and whereby a first light source is disposed at the inner side of the rotator. The light-shielding mask means allows light from the first light source to be transmitted through the symbol tape where one or more special symbols are drawn and prohibits the light to be transmitted through the other areas of the tape. In this case, the rotary body structure may be further equipped with control means to cause the first light source to turn on while the rotator is rotated and to cause the first light source to blink on and off when the rotator has stopped in a prize-winning combination. The rotary body structure may be further equipped with a second light source disposed at the inner side of the rotator and with a control means for controlling the first and second light sources.

In the invention as described above, the specific symbols on the periphery of the rotary reel which are luminescent, which have been stereoscopically processed, or which are selectively highlighted relative to other symbols on the rotary reel using a light-shielding mask means have greater attention attracting power than other symbols, and are remarkably conspicuous. Therefore, the player's attention is concentrically paid to these symbols irrespective of the rotational or stopping state of the rotator.

BRIEF DESCRIPTION OF THE DRAWINGS

FIG. 16 is a table showing rotary reel operation and control states of the two light sources contained in a seventh embodiment of this invention.

DETAILED DESCRIPTION OF THE INVENTION

Figure 1:
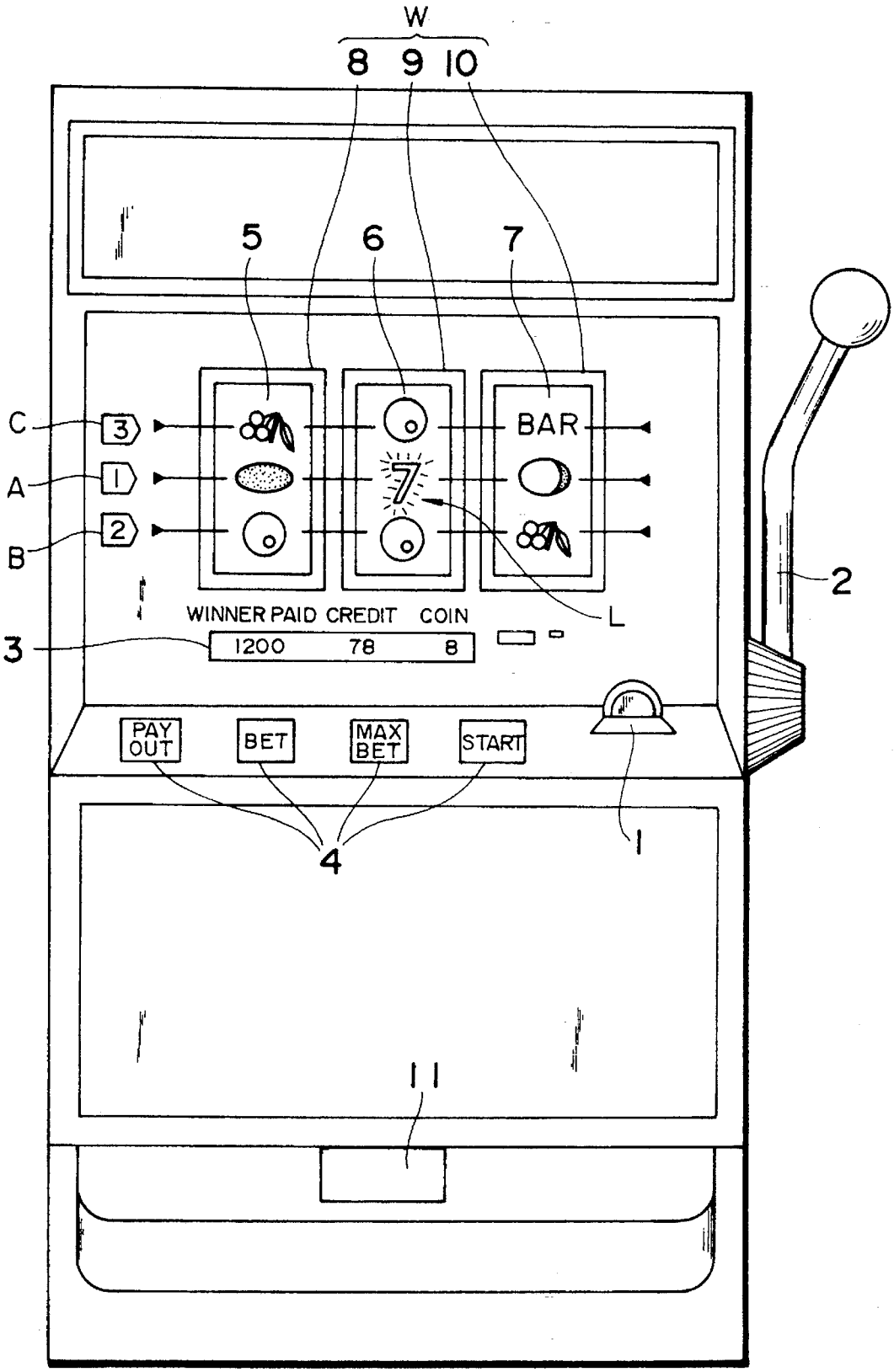
FIG. 1 is a front view of a slot machine embodiment of a gaming device containing a rotating reel mechanism according to one embodiment of this invention.

FIG. 1 illustrates a profile of a slot machine in accordance with a first embodiment of this invention. This slot machine comprises a coin insert port 1, a start lever 2, a display unit 3, a set of selection buttons 4, a first rotary reel 5, a second rotary reel 6, a third rotary reel 7, and display windows 8, 9 and 10 for the respective rotary reels.

Before a game is started, a player inserts a coin through the coin insert port 1. In the game, the effective prize-winning lines A, B and C shown in FIG. 1 are determined in accordance with the number of coins which are inserted. For example, only A is used as a prize-winning line for insertion of one coin, and each of A, B and C is used as a prize-winning line for insertion of three coins. The probability of winning a prize is thus increased in proportion to the number of inserted coins. The number of coins which have been inserted is displayed as a digital number on the display unit 3. The game is started by pulling the start lever 2 or pressing a START button, which is one of the selection buttons 4. The first rotary reel 5, the second rotary reel 6, and the third rotary reel 7 are then rotated at the same time.

The rotary reels are stopped after a predetermined time elapses. At this time, a win for the game and the number of coins to be paid are determined in accordance with a combination of symbols stopped on the prize-winning lines. Since the reels are rotated at a relatively high speed at an initial stage of rotation, each symbol cannot be identified at the initial stage. However, immediately before the rotary reels are stopped, their rotational speed is lowered, and thus each symbol can be identified. At this stage, the player pays attention to those symbols for which a high number of coins is paid. Upon alignment of the same symbols on a prize winning line, a predetermined number of coins are paid. These coins are paid to the player through a coin discharge port 11.

Figure 2:
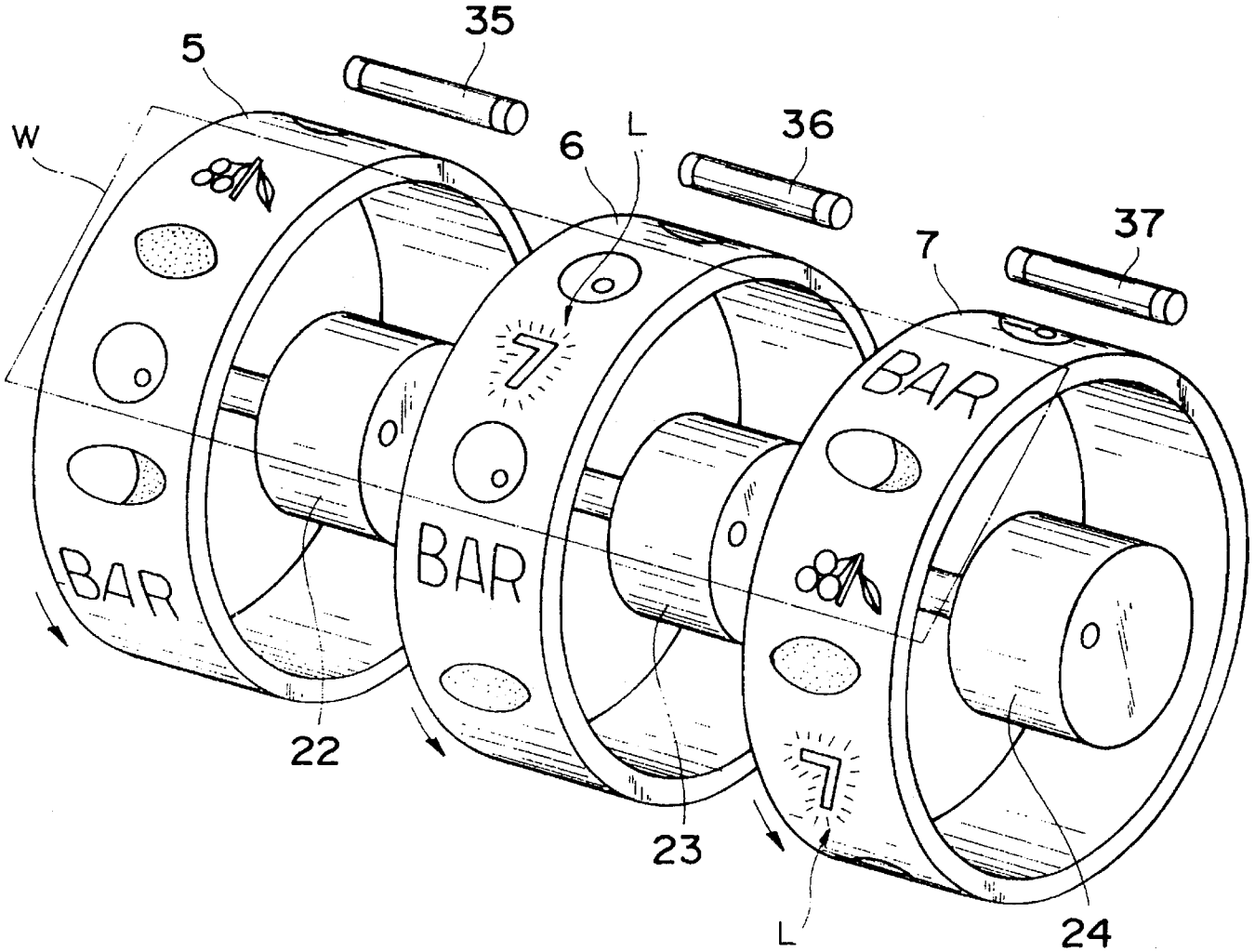
FIG. 2 is a perspective view of a rotary body structure which may be used in the gaming device of FIG. 1.
Figure 3:
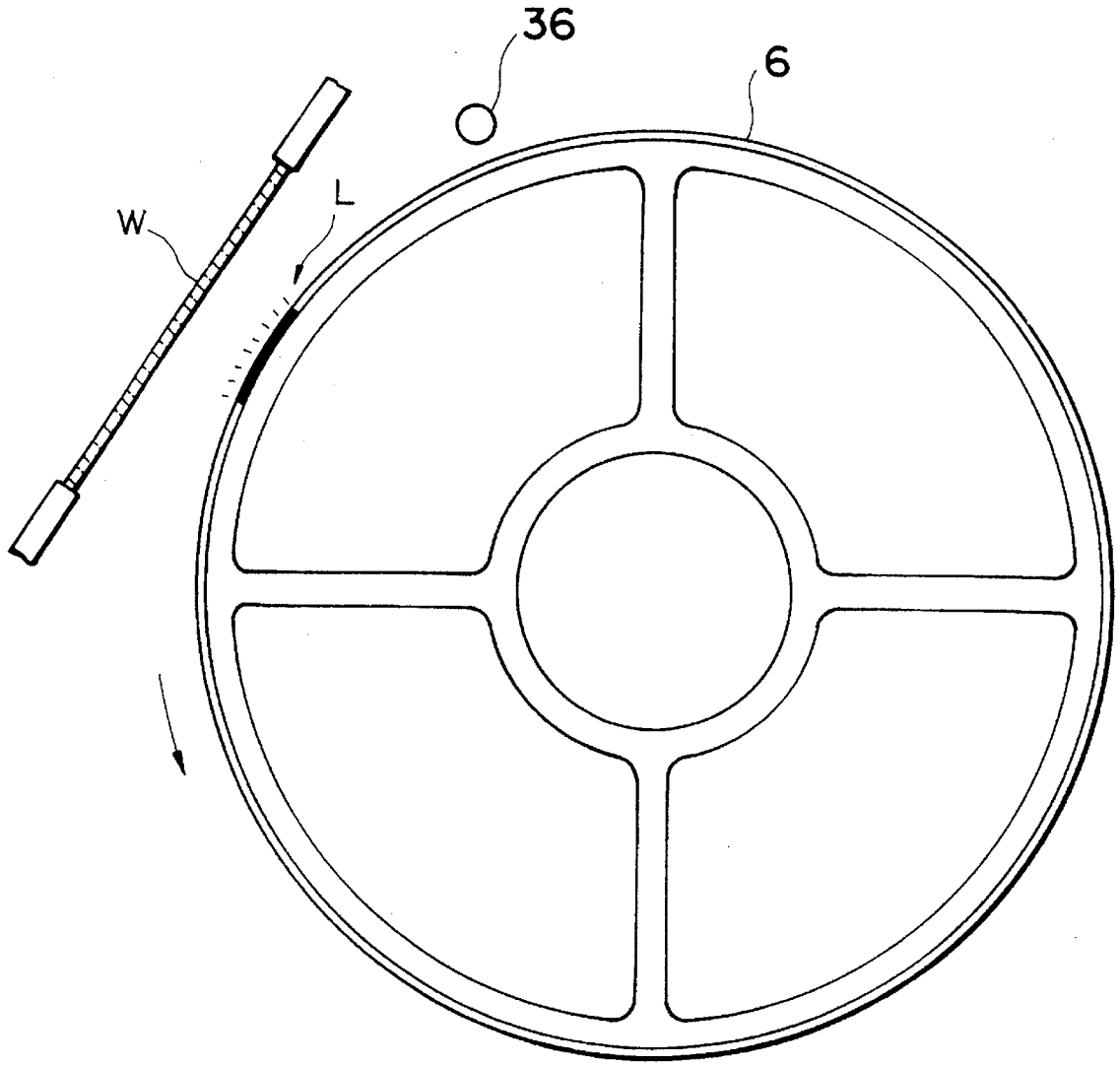
FIG. 3 is a side view of a rotary reel contained in the rotary body structure of FIG. 2, which is viewed along the rotational axis of the rotary reel.

FIG. 2 is a perspective view of a rotary body structure which is applicable to the first embodiment of this invention. FIG. 3 is a side view of a rotary reel contained in the rotary body structure of FIG. 2.

The rotary body structure of FIG. 2 comprises the first rotary reel 5, the second rotary reel 6, the third rotary reel 7, stepping motors 22, 23, and 24, and light sources 35, 36, and 37. The rotary reels 5, 6, and 7 are driven by the stepping motors 22, 23, and 24, respectively. The rotary reels 5, 6, and 7 each further comprise a reel tape, wound around the outer peripheral surface of the rotary reel, on which one or more symbols is drawn.

At least one of the symbols (e.g., symbol "7") which are drawn on each reel tape is a luminescent symbol L. The luminescent symbol L comprises a phosphorescent, or a fluorescent, or an otherwise luminescent material. A phosphorescent material is capable of emitting light for a period of time upon reception of light energy. A fluorescent material is capable is emitting light during reception of light or other energy. The luminescent symbol is formed by any suitable method for printing phosphorescent, fluorescent, or otherwise luminescent ink, paint, or powder on the surface of the tape, such as described in *Image Optics Handbook* 268–69 (Kenji Hiwatari ed., Asakura Shoten pub., 1986).

FIGS. 1, 2 and 3 include a window area W comprising display windows 8, 9 and 10 disposed in front of the rotary reels 5, 6 and 7. In the case where the luminescent symbols L are phosphorescent, conventional light sources 35, 36 and 37 for irradiating the phosphorescent symbols L are disposed in front of the window area W and at the upper side of the rotary reels 5, 6 and 7, respectively. As indicated in FIG. 3, the rotation of the reels 5, 6 and 7 is such that the phosphorescent symbols L are irradiated with light immediately before appearing in the window W, and thus emit light at least during the period in which they pass through the window W and are visible to the player. Accordingly, the player accurately identifies the phosphorescent symbols L through the display windows and becomes more excited by the appearance of these special symbols. The physical placement of the light sources 35, 36 and 37 and the spacing between the reels 5, 6 and 7 are based on factors including the light intensity emitted by the light sources 35, 36 and 37, the afterglow time (decay constant) of the phosphorescent material contained in the phosphorescent symbols L, and the rotating speed of the rotary reels.

Figure 4:
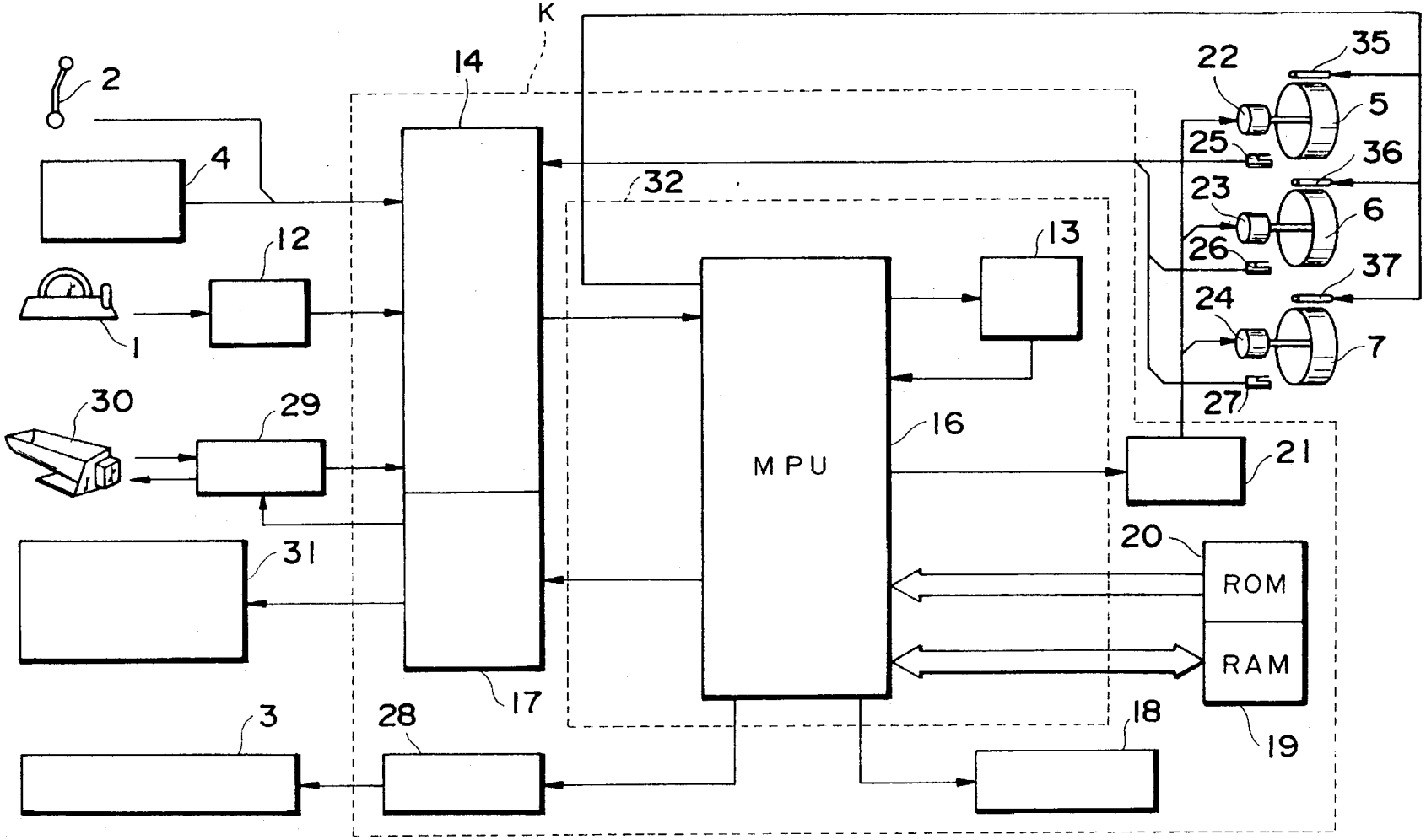
FIG. 4 is a block diagram of a control circuit which may be used in the gaming device of FIG. 1.

FIG. 4 is a block diagram of a control circuit K which is applicable to the gaming device of the first embodiment of this invention. The rotary reels 5, 6 and 7 are driven by a microcomputer unit 32 and a driver circuit 21, and a stop position of each rotary reel is determined in accordance with a random number generated by a random number generator 13. The stop position of the first reel 5 is determined at the time when a coin is inserted, and the stop positions of the second and third rotary reels 6 and 7 are determined at the time when the START button of the selection buttons 4 is pressed or when the start lever 2 is pulled. In one example of the invention, a 13-bit register is used for the random number generator 13, which therefore generates 8192 ($=2^{13}$)

possible random numbers. When the first reel 5, the second reel 6, and the third reel 7 stop, symbols on the first, second and third reels 5, 6 and 7 are aligned on the prize-winning lines A, B and C. If a combination of symbols for winning a prize is realized on any prize-winning line, the appropriate number of coins is paid from the coin discharge port 11. The number of coins to be inserted and the number of coins to be paid are displayed simultaneously on the display unit 3, and the game is terminated.

If a game is started after a BET button (one of the selection buttons 4 in FIG. 1) is pressed, no coin is paid from the coin discharge port 11 upon a win. Rather, a number corresponding to the number of coins to be paid is displayed in a CREDIT column of the display unit 3. The number displayed in the CREDIT column is treated as a balance of actual coins corresponding to the number displayed. Each press of the BET button is regarded as the insertion of one coin from this balance, and the number displayed in the CREDIT column of the display unit 3 is decremented by 1. If a MAX BET button (another of the selection buttons 4) is pressed, it is regarded as inserting a number of coins corresponding to the maximum number allowed for a single game, and the CREDIT column of the display unit 3 is decremented by this maximum number. If a PAY OUT button (another of the selection buttons 4) is pressed, a number of coins corresponding to the number displayed in the CREDIT column of the display unit 3 are paid from the coin discharge port 11.

FIG. 4 also includes a microprocessor unit (MPU) 16 coupled to the light sources 35, 36, and 37. When a game is started, the MPU 16 allows the light sources 35, 36 and 37 to turn on in response to a signal input through an input port 14. An example in which the luminescent symbols L are phosphorescent is described below. Since the reels 5, 6 and 7 are rotated simultaneously with the start of the game, the phosphorescent symbols L pass in close proximity to the light sources 35, 36 and 37. At this time, the phosphorescent symbols L are supplied with light energy from the light sources 35, 36, and 37 sufficient to allow a phosphorescent afterglow of a duration corresponding at least to the time period in which the phosphorescent symbols L appear in the window W. Therefore, the phosphorescent symbols L are particularly conspicuous and thus attract the player's attention more intensely than do the other symbols appearing in the window W.

In one embodiment of the invention, the MPU 16 may control the light sources 35, 36 and 37 such that light is applied to the phosphorescent symbols L several rotations before the rotary reels 5, 6, and 7 are stopped, or such that light is applied several rotations before a period during which phosphorescent symbols L would otherwise be emitting light. Such alterations to the lighting of the phosphorescent symbols may be realized in either hardware or software. This type of lighting operation may be effective, for example, in a case where a special payout is applied only during the lighting of the symbols, or in a case where some other game variation is to be represented. In addition, the lighting time can be shortened, and thus it is economical.

By controlling the emission of light by the phosphorescent symbols L to represent game variations on a dynamic basis as described above, player excitation and game amusement are further promoted.

FIG. 4 also illustrates a coin detector 12, a coin payout counter 29 and tray 30, various output displays and registers 3, 28, 31, 18, an output port 17, memories 19, 20, and position sensors 25, 26, 27.

Figure 5:
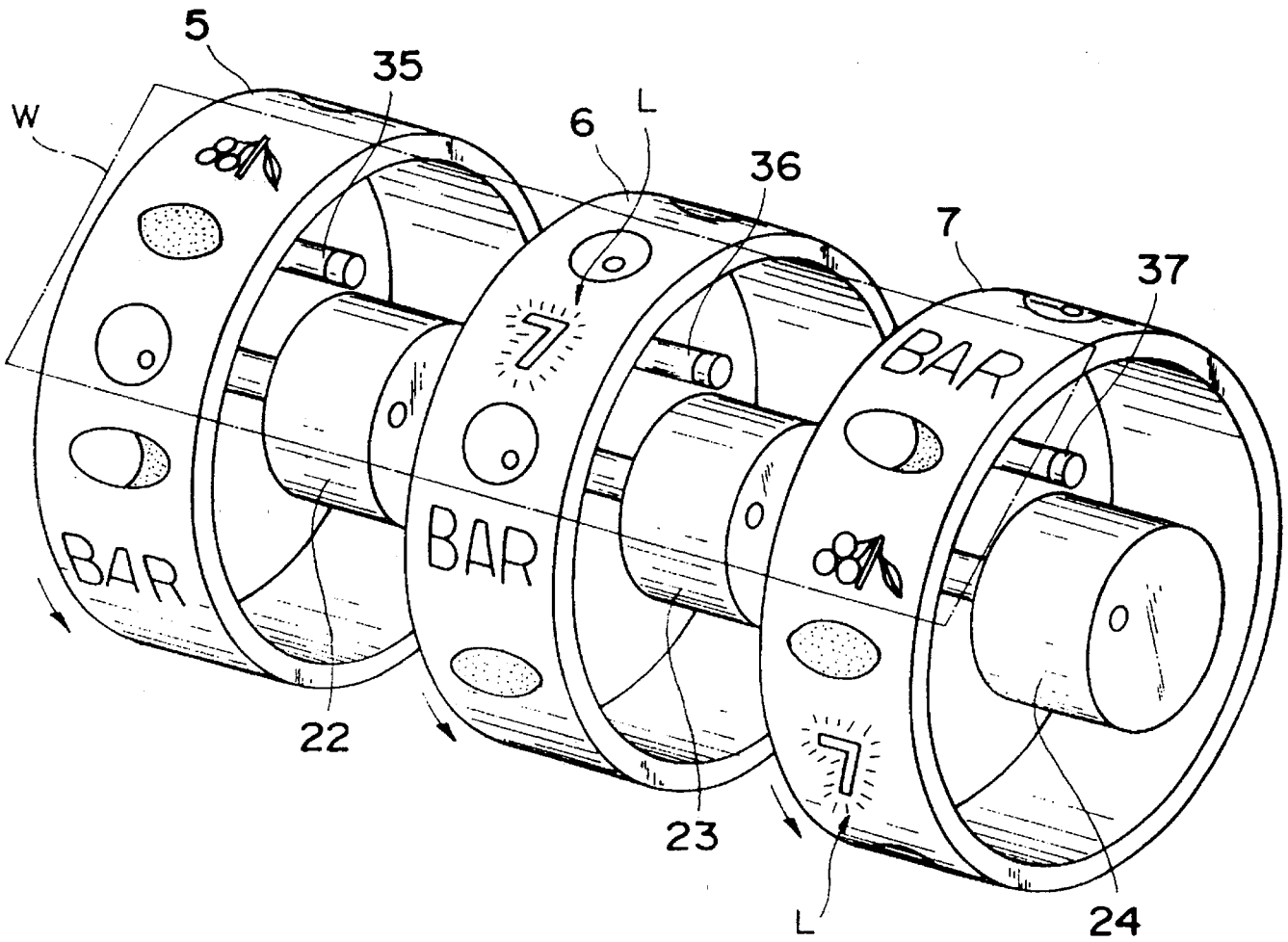
FIG. 5 is a perspective view of a rotary body structure which is applicable to a gaming device according to a second embodiment of this invention.
Figure 6:
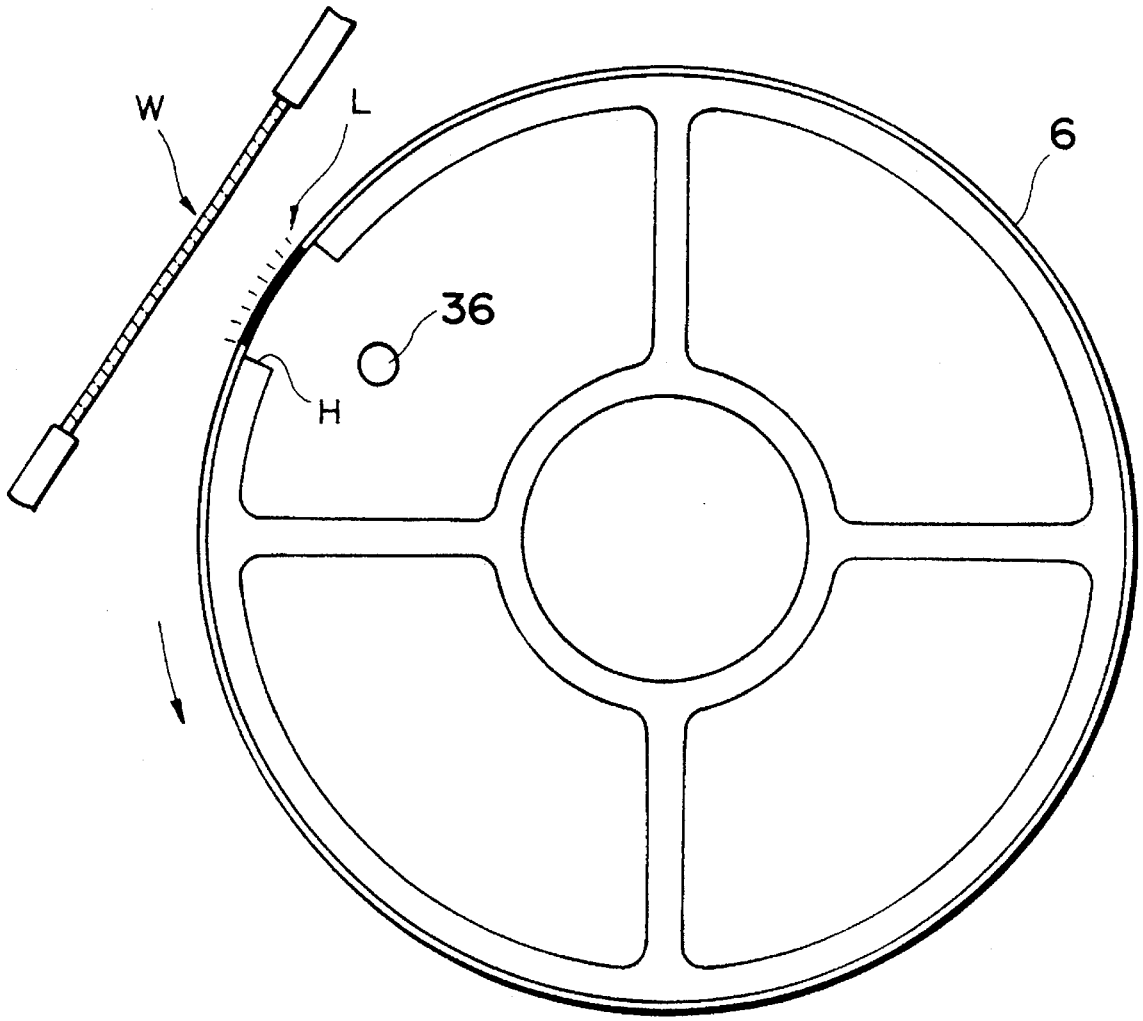
FIG. 6 is a side view of a rotary reel contained in the rotary body structure of FIG. 5, which is viewed along the rotational axis of the rotary reel.

FIG. 5 is a perspective view of a rotary body structure in accordance with a second embodiment of the invention. FIG. 6 is a side view of a rotary reel contained in the rotary body structure of FIG. 5.

The light sources 35, 36 and 37 used in the second embodiment are different from those of the first embodiment in that they are disposed within the circumference of the rotary reels 5, 6, and 7 and opposite the display window W with respect to displayed surfaces of the reels 5, 6 and 7. The rotary reels 5, 6 and 7 are designed such their inner peripheral surfaces are translucent at the locations in which the luminescent symbols L are placed so as to pass light from the light sources 35, 36 and 37 at these locations. As shown in FIG. 6, the peripheries of the rotary reels 5, 6 and 7 are formed with openings H to achieve this purpose.

Accordingly, when the luminescent symbols L appear through the window W, they are irradiated with light from the light sources 35, 36, and 37, and thus will emit light. In this case, since the light is directly irradiated onto the luminescent symbols, the light-emission intensity of this embodiment is greater than the first embodiment described above. In this case, in order to heighten contrast between the luminescent symbols and the other symbols, the back surfaces of the symbols other than the luminescent symbols may be subjected to a mask treatment through which the light transmission is prevented.

In this embodiment of the invention, light energy is applied to the symbols L as they appear in the window W. As a result, the phosphorescent or fluorescent nature of the symbols L is not a critical factor. As an option, then, if light transmissible material is used for the special symbols on the reel tape and the back surfaces of the non-highlighted symbols are provided with masks through which no light is transmissible, the light emission can be performed without phosphorescent paint, fluorescent paint, or otherwise luminous paint. Therefore, a product according to the second embodiment of the invention can have a low price.

The control circuit K of the first embodiment of this invention, shown in FIG. 4, is directly applicable to the second embodiment and is not discussed further.

Figure 7:
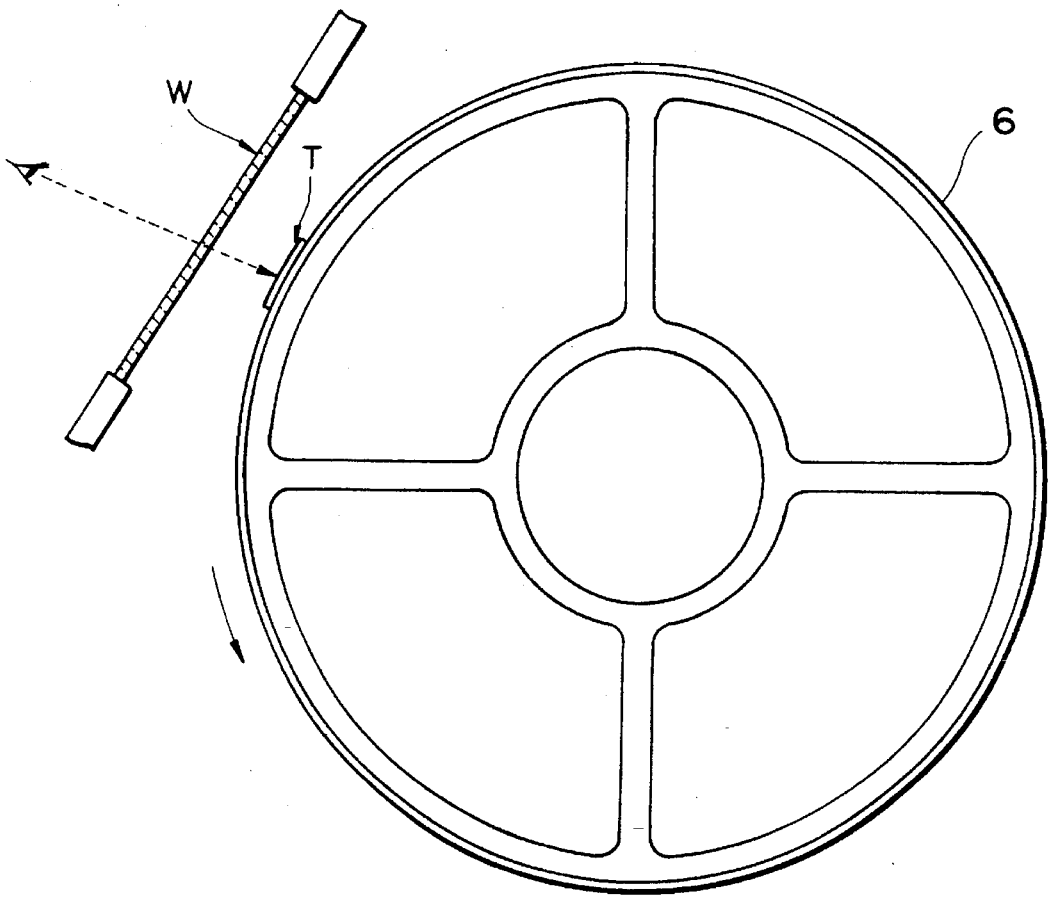
FIG. 7 is a side view of a rotary reel contained in a rotary body structure which is applicable to a gaming device according to a third embodiment of the invention.
Figure 8:
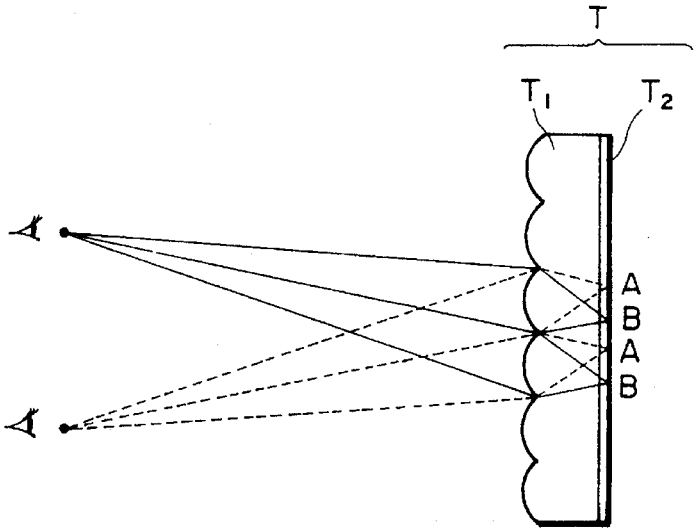
FIG. 8 illustrates the principle of stereoscopic imaging applied in the third embodiment of the invention.

FIG. 7 is a side view of a rotary reel contained in a rotary body structure in accordance with a third embodiment of the invention. FIG. 8 illustrates the principle of stereoscopic imaging applied in the third embodiment of the invention.

In the gaming device of this embodiment, at least one stereoscopic image symbol T which has been subjected to a conventional stereoscopic imaging process is formed on the surface of the reel tape affixed around the periphery of the rotary reel. The stereoscopic image symbol T comprises a lenticular sheet T1 which is placed on a stereoscopically processed composite picture T2. One surface of the lenticular sheet T1 is corrugated, each corrugation serving as a one-dimensional convex lens which bends light along one axis. The one-dimensional corrugations thus give the lenticular sheet a columnar appearance. A side view of the lenticular sheet T1, taken along a cross-section perpendicular to the column directions, is shown in FIG. 8.

The stereoscopically processed composite picture T2 is fixed to the back surface of the lenticular sheet T1, and comprises plural picture segments A, B alternately arranged, as illustrated in FIG. 8. Each picture is taken from a different perspective of a three-dimensional object or symbol. Such composite pictures can be easily formed using a camera having a stereoscopic photographing function, one such camera being the Nishika N8000, which is manufactured in the United States. Such pictures, however, may also be formed using a single eye camera such as a studio camera, a portable camera, or a large aperture camera or the like. Additionally, a multi-eye camera such as a one-shot camera may be used. See *Print Engineering Manual* 1117–19 (Nippon Print Association eds.).

In this embodiment of the invention, the plural images contained in the composite picture are taken from different horizontal angles, a parallax in the horizontal direction (herein termed "horizontal parallax") being achieved. The composite picture contains images for the right and left eyes and, when viewed through the lenticular sheet T1 placed such that its columns are vertical, the images enter the right and left eyes independently of each other, and a stereoscopic effect in the form of a horizontal parallax is observed.

Figure 9:
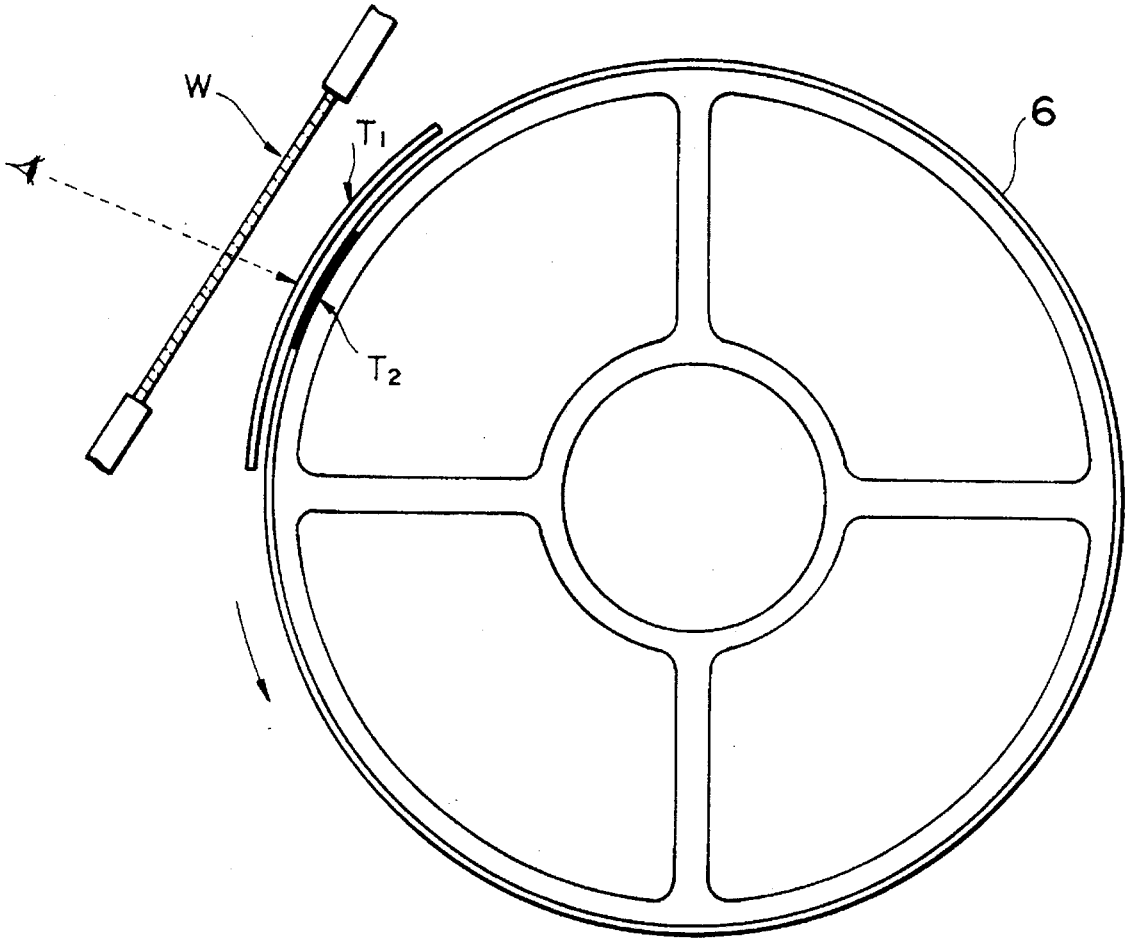
FIG. 9 is a side view of a rotary reel contained in a rotary body structure which is applicable to a gaming device according to a fourth embodiment of the invention.
Figure 10:
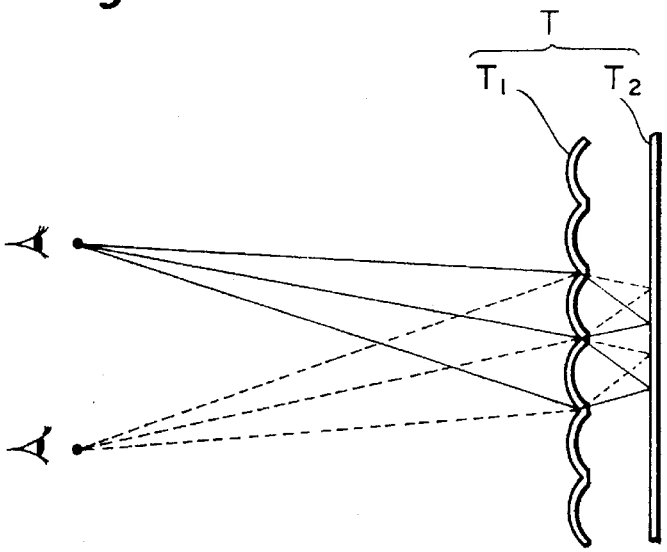
FIG. 10 illustrates the principle of stereoscopic imaging applied in the fourth embodiment of the invention.

FIG. 9 is a side view of a rotary reel contained in a rotary body structure in accordance with a fourth embodiment of the invention. FIG. 10 illustrates the principle of stereoscopic imaging applied in the fourth embodiment of the invention.

In the fourth embodiment of the invention the lenticular sheet T1 and the stereoscopically processed composite picture T2 which together constitute a stereoscopic image symbol T are separated from each other. The stereoscopically processed composite picture T2 is attached to the reel tape, whereas the lenticular sheet T1 is at a fixed position between the window W and the rotary reels 5, 6 and 7. The lenticular sheet T1 is curved so as to be adjacent to the surface of the rotary reels 5, 6, and 7, as shown in FIG. 9. The lenticular sheet T1 may be of a width sufficient to cover the area covered by the window W, or may be sized so that only a part of the area covered by window W is covered. In a case where this embodiment of the invention is applied to a slot machine to create ghost-like images, the composite picture T2 may cover the whole of the reel tape which surrounds the periphery of rotary reels 5, 6, and 7. In this case, the reel tape may be blank except for the stereoscopic image symbol T.

Figure 11:
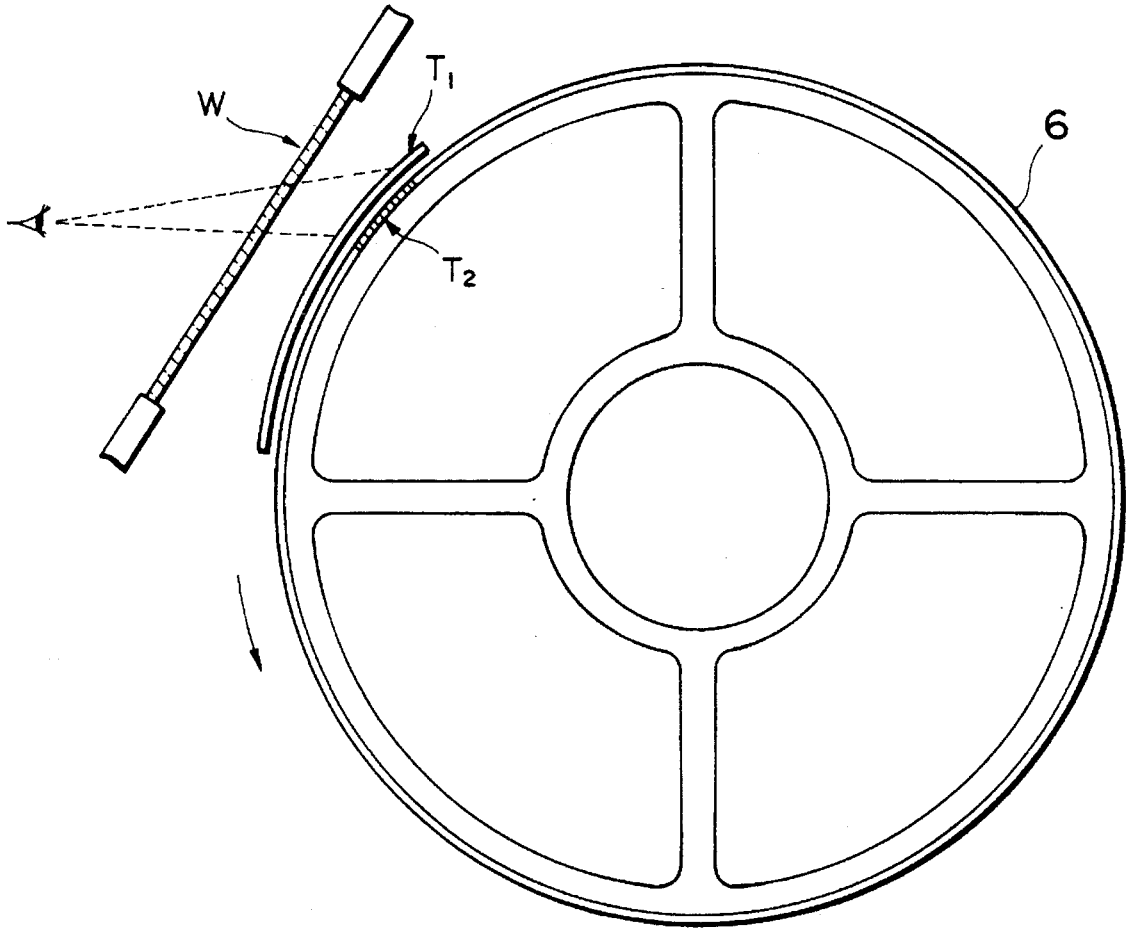
FIG. 11 is a side view of a rotary reel contained in a rotary body structure which is applicable to a gaming device according to a fifth embodiment of the invention.
Figure 12A:
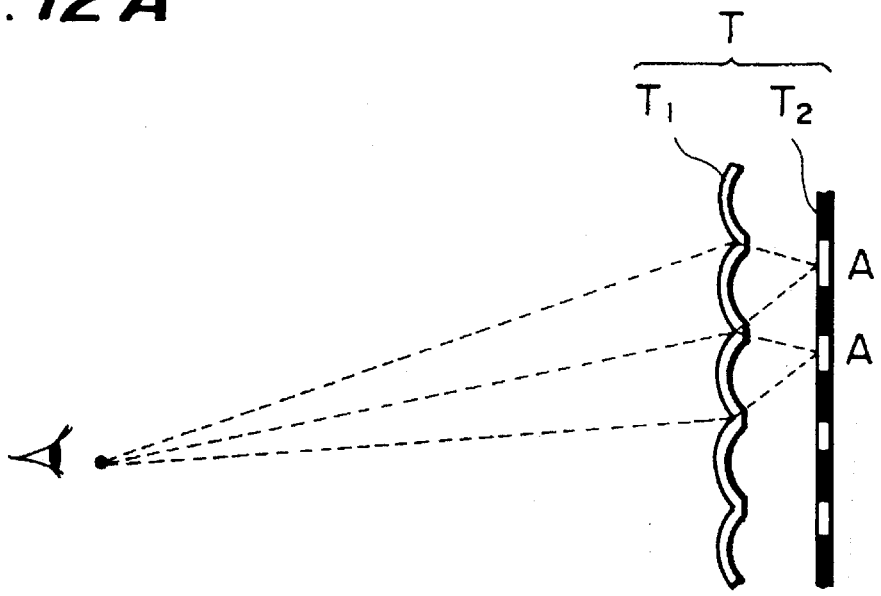
FIGS. 12A and 12B are explanatory diagrams showing the principle underlying the animation applied in the fifth embodiment of the invention.
Figure 12B:
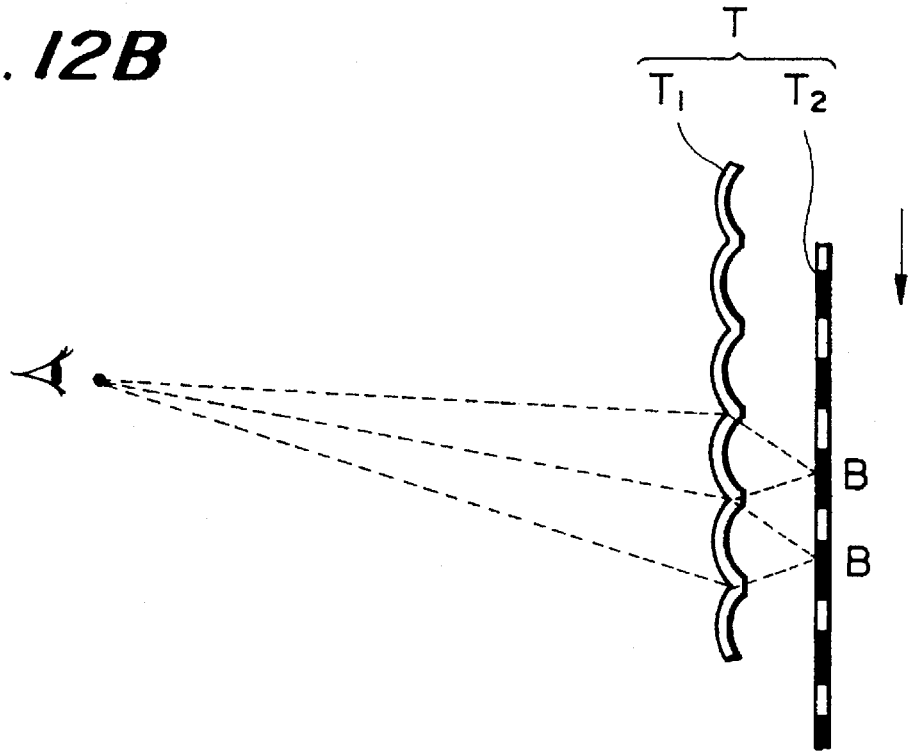

FIG. 11 is a side view of a rotary reel contained in a rotary body structure in accordance with a fifth embodiment of the invention. FIGS. 12A and 12B illustrate the principle of stereoscopic imaging applied in the fifth embodiment of the invention.

In the fifth embodiment of the invention the columns or corrugations of the lenticular sheet T1 are oriented horizontally, as opposed to the vertical orientation of the columns or corrugations in the previous embodiments. Further, the stereoscopically processed composite picture T2 is processed so as to achieve a stereoscopic effect in the form of a vertical parallax when placed behind the lenticular sheet T1. Even further, the stereoscopically processed composite picture T2 comprises plural images of entirely distinct scenes, unlike the previous embodiments in which the composite picture comprised views of an identical scene as viewed from different angles. Combining this physical configuration with the rotation of the rotary reels 5, 6, and 7, an animation effect is achieved because the stereoscopically processed composite picture T2 can comprise images which vary in accordance with the variation of their vertical visual angle.

FIGS. 12A and 12B illustrate the principle that underlies this resulting animation effect. When the stereoscopically processed composite picture T2 arrives at the upper position of the lenticular sheet T1, for example, the player views a first image A by the action of the lenticular sheet T1 as shown in FIG. 12A. Following the rotation of the rotary reel, the visual angle at which the player views the stereoscopically processed composite picture T2 changes. When the stereoscopically processed composite picture T2 arrives at the lower position of the lenticular sheet T1, the player can view a second image B as shown in FIG. 12B. If the first and second images have a continuous relationship, an animation effect is achieved. For example, the first image might be a view of a rose bud, while the second image is a view of a rose in full bloom. The number of continuous images in this embodiment of the invention is not limited to two. The stereoscopically processed composite picture T2 may comprise more than two such continuous images such that an even finer animation is achieved. The multiple images may be views of a rose in gradual stages of bloom, for example, or may be of a volcano in stages of eruption.

In this embodiment of the invention the player's expectation is intensified and the amusement of the game is improved through the appearance of the specially processed symbols T during the rotation of the rotary reel. Since these symbols are more conspicuous than the other symbols, the player is impressed with the apparent existence of a much larger number of symbols than are actually spatially contained on the periphery of the rotary reel. Further, a near-miss effect can be attained according to this embodiment of the invention, and the player feels optimistic even if the symbols ultimately appear as a part of a non-prize-winning combination.

Figure 13:
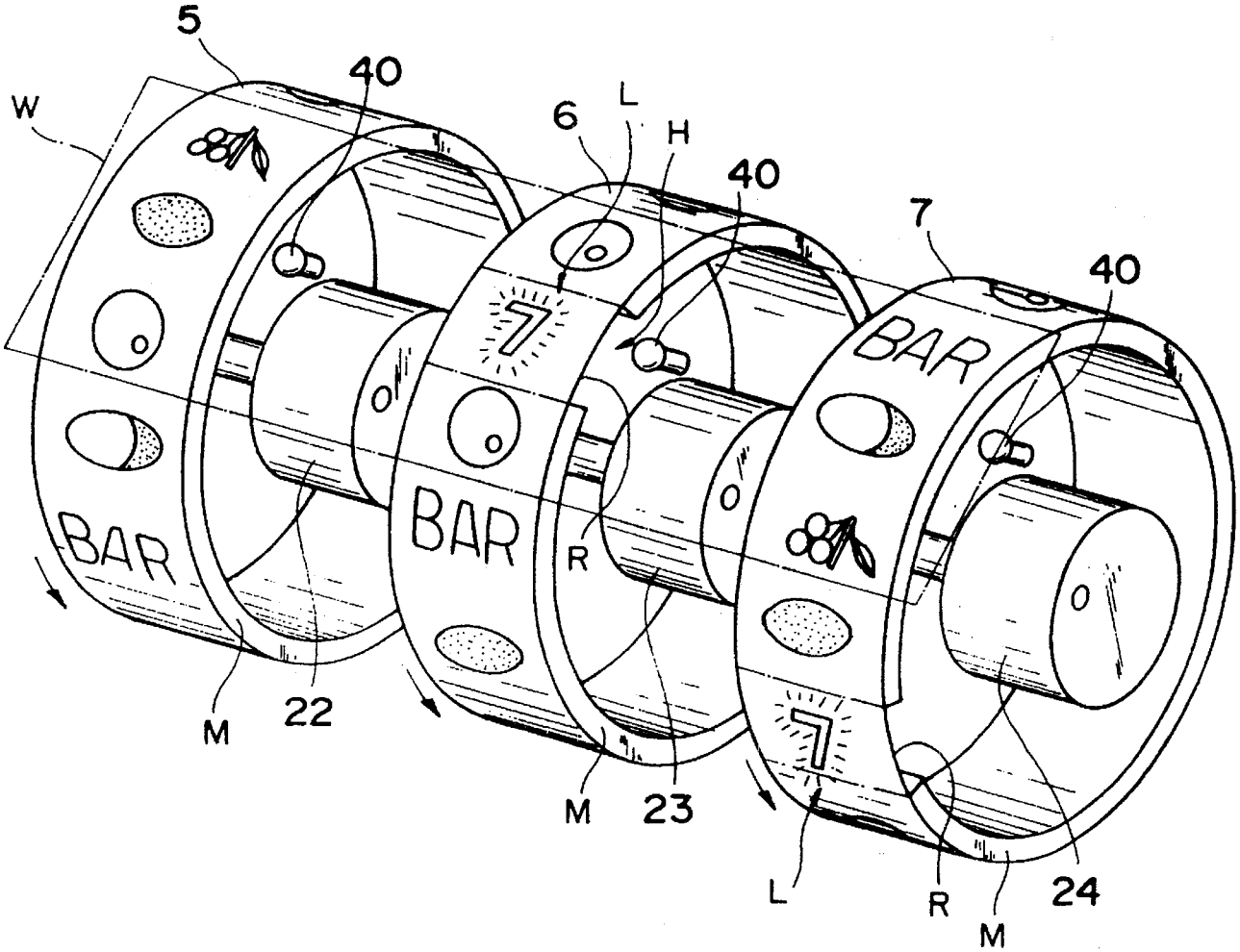
FIG. 13 is a perspective view of a rotary body structure which is applicable to a gaming device according to a sixth embodiment of this invention.
Figure 14:
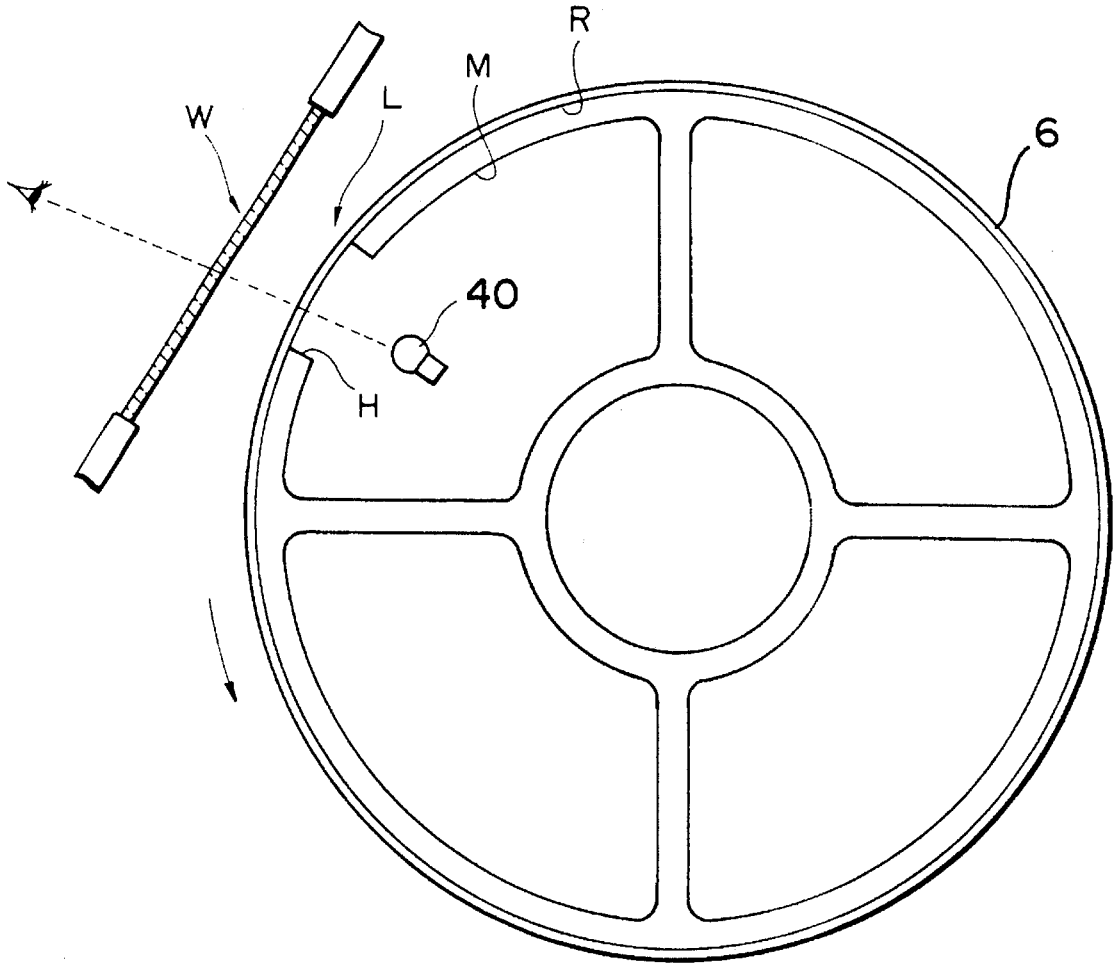
FIG. 14 is a side view of a rotary reel contained in the rotary body structure of FIG. 13, which is viewed along the rotational axis of the rotary reel.
Figure 15:
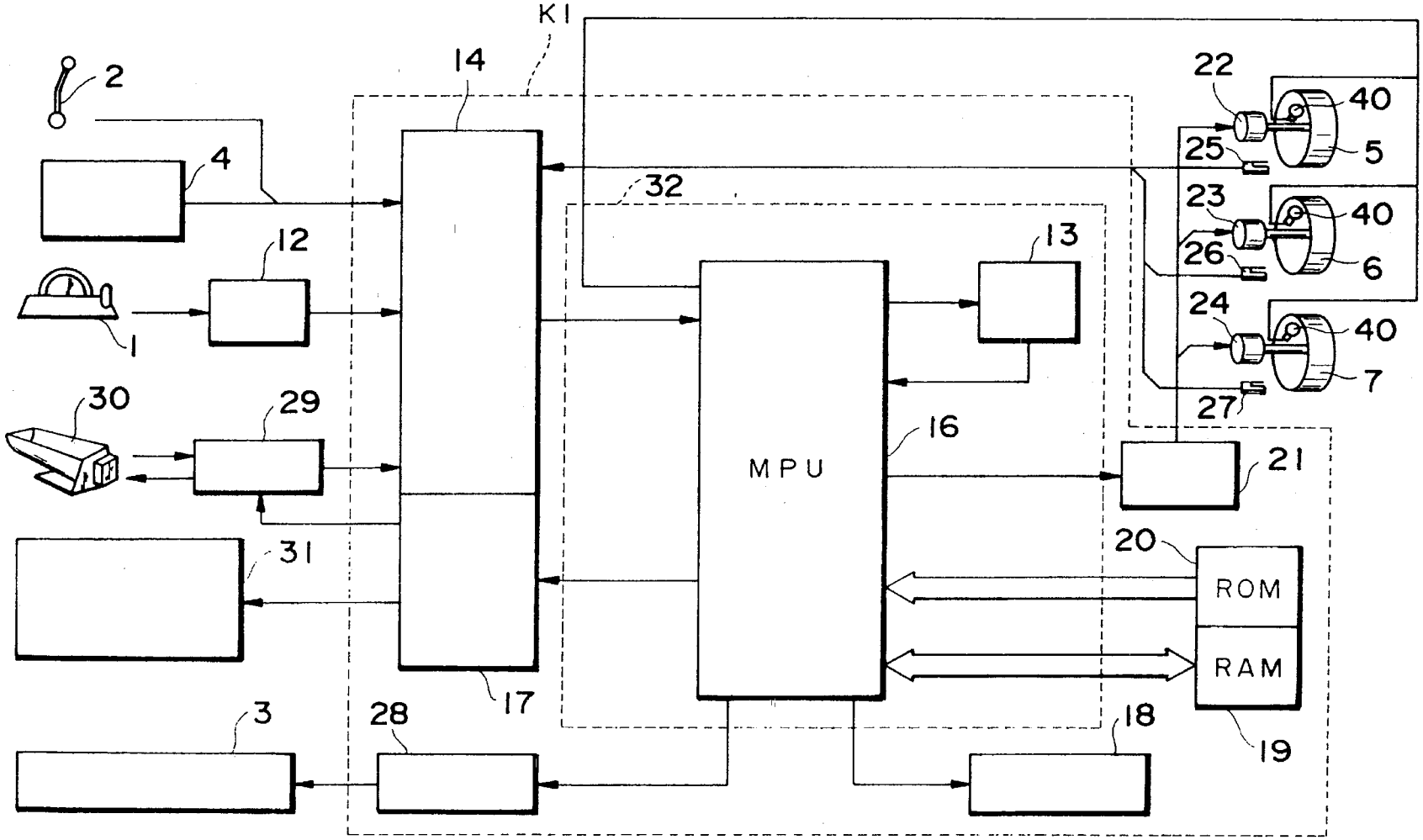
FIG. 15 is a block diagram of a control circuit which is applicable to the gaming device of the sixth embodiment of this invention.

FIG. 13 is a perspective view of a rotary body structure in accordance with a sixth embodiment of the present invention. FIG. 14 is a side view of a rotary reel contained in the rotary body structure of FIG. 13. FIG. 15 illustrates a block diagram of a control circuit K1 which is applicable to the gaming device of the sixth embodiment of this invention. The invention according to the sixth embodiment is similar to the invention according to the second embodiment with some differences.

As shown in FIGS. 13 and 14, the rotary reel structure is such that a mask member M formed of a light shielding material is disposed at the back side of a semi-transparent reel tape R. The mask member M is partially provided with an opening H, and the reel tape R is affixed around the rotary reel. The openings H are provided in order to back-light the special symbols L. The reel tape R is a transparent reel tape which has been subjected to a light-transmissible print treatment. This reel tape can be formed at low cost by first printing symbols on the back surface of transparent tape material with a light-transmissible color ink, then printing a background with a light-transmissible white ink, and finally removing a special symbol area to conduct a light-shielding mask process using a silver print.

FIGS. 13 and 14 include a window area W disposed in front of the rotary reels 5, 6 and 7, along with light-emitting sources 40 disposed on the inside of the rotary reels 5, 6, and 7 opposite the window W with respect to the reel tape symbols. The light-emitting sources 40 irradiate light to the special symbols L described above. When the special symbols L appear at the window W, the player can view these symbols as back-lighted by the light-emitting sources 40. Therefore, the player views the symbols as if only these symbols emit light. Accordingly, the player recognizes the light-emitting symbols L through the display windows and is impressed with these symbols.

FIG. 15 illustrates a block diagram of a control circuit K1 which is applicable to the gaming device of the sixth embodiment of this invention. FIG. 15 includes an MPU 16 which is coupled to the light-emitting sources 40. The MPU 16 contains a control circuit for controlling the light-emitting sources 40 and a memory in which a program for controlling the light-emitting sources 40 is stored. In this embodiment of the invention, when the game is started the MPU 16 allows the light-emitting sources 40 to turn on in response to a signal input through an input port 14. The light-emitting sources 40 are on continuously during the game. Since the player views the special symbols L as backlighted by the light sources 40 every time the special symbols L pass through the window W, the special symbols L are more conspicuous than the other symbols.

In a modified embodiment of the invention, the MPU 16 may so control the light-emitting sources 40 such that, upon the occurrence of a prize-winning combination, the light-emitting sources 40 will be on continuously while the rotary reels 5, 6 and 7 are rotated, and then will be flashed on and off for a period of time. This period of time may correspond, for example, to the period of time necessary for the winning of coins to be completed. Such a modification can be simply realized by a hardware control circuit or a software program. As a result of the lighting of the special symbols L as described above, the special symbols L are made more conspicuous and the game is more exciting.

FIG. 16 is a table showing the operation of a rotary body structure and the corresponding light source control states in accordance with a seventh embodiment of the invention. In this embodiment of the invention, a second set of light sources is provided in addition to the light sources 40 described above. The second set of light sources emit a different color of light than the light sources 40 emit. The second set of light sources is positioned such that their light can radiate through the special symbols L to the window W. For example, the second set of light sources may be adjacent to the respective light sources 40. The second set of light sources are controlled by a control means built in the MPU 16.

The MPU 16 may be put into one or more modes, the operation according to each mode being shown in FIG. 16. The controlling of the light sources 40 (denoted "Light Sources #1" in FIG. 16 and "first light source" herein) and the second set of light sources (denoted "Light Sources #2" in FIG. 16 and "second light source" herein) is further made dependent on whether the associated rotary reel is rotating or whether it is stopped. As shown in FIG. 16, according to a first mode, only the first light source turns on while during rotation, and only the second light source turns on when the rotation stops. If the color of the first light source is, for example, white, and the color of the second light source is, for example, red, the special symbols L appear white during rotation and red when the rotation stops. According to a second mode, only the second light source is on during rotation, and the first light source turns on when the rotation stops, so that the intensity of the light is heightened when the rotation stops. According to a third mode, only the first light source is on during rotation, and when the rotation stops, the first light source is turned off and the second light source flashes on and off (denoted by "flash" in FIG. 16). According to a fourth mode, the first light source and the second light source are both on during rotation, whereas the first light source is turned off and the second light source flashes on and off when the rotation stops. Therefore, when the special symbols L are stopped within the window W, the special symbols L flash and blink, so that player's attention is attracted. According to a fifth mode, only the first light source flashes on and off during rotation, and the second light source flashes on and off when the rotation stops. A great effectiveness of the special lighting is achieved where white light flashes from the first light source and red light flashes from the second light source. According to a sixth mode, only the second light source flashes on and off during rotation, but the first light source and second light source both flash on and off when the rotation stops. Since the intensity of the light is heightened, the stopped special symbols are more exciting.

Other than as described above, the remainder of the device in accordance with this embodiment of the invention is substantially similar to the previous embodiment, and the description therefore is omitted.

Using the embodiments of the invention described above, the results yielded by a gaming device can be improved, and thus the results obtained by the establishment in which it is placed can be improved, and the results of the establishment which manufactures the gaming device can be improved. It is further noted that the manufacturing cost is low and no special facilities are required.

This invention is not limited to the embodiments as described above. For example, in the third, fourth, and fifth embodiments of the invention as described above, a holography technique may be used as a method for displaying a stereoscopic image. See *Print Engineering Manual* 1119–25, Nippon Print Association eds.

Further, in the seventh embodiment of the invention, in modes in which the first and/or second light sources turn on and off, the MPU 16 may be so controlled that the rotational speed of the rotary reel is detected and the light sources flash on and off in synchronicity with the period of rotation of the rotary reel. In this case, the special symbols L are viewed by the player as being continuously on during rotation at a constant speed, and are viewed as flashing on and off when the rotation stops.

Further, in the sixth and seventh embodiments as described above, a light-scattering member may be disposed at the back surface side of the reel tape on which the special symbols are displayed, so that an area of the reel tape in the vicinity of the special symbols L is vaguely brilliant.

Further, the above embodiments are described for a gaming device which accepts coins from the user, but this invention is not so limited. In place of coins, a credit card or other credit system may be used. Such a credit system may credit up and give points for replay, may pay out by converting credit points to money, or the like. The device may be a pinball machine which gives extra balls for play. Therefore, a coin insertion device and/or a coin output device or the like is not necessarily required.

This invention is applicable to any gaming machine equipped with one or more rotary reels which contain symbols on their outer periphery to be viewed the player, such as slot machines, pinball machines, slot-and-pinball machines, and other devices. It is further noted that the descriptive term "gaming device" or "gaming machine" is not intended to limit the scope of the invention to devices used for playing games for stakes.

It is further noted that the above embodiments describe a slot machine equipped with three rotary reels which are rotated around a horizontal axis. This invention is not limited to such a slot machine. For example, the number of reels of the slot machine is not limited to three, and the rotary reels may be rotated around a vertical axis or axis of other orientation.

What is claimed is:

1. An amusement device comprising:

one or more rotary reels for displaying on their respective outer peripheral surfaces one or more symbols, at least one symbol being a stereoscopically processed composite picture; and a lenticular sheet positioned over said composite picture for stereoscopic presentation of said stereoscopically processed composite picture.

2. The device as recited in claim 1, wherein said lenticular sheet has the same radius of curvature as one of said rotary reels.

3. The device as recited in claim 1, wherein said stereoscopically processed composite picture is formed of successive images which together achieve a parallax.

4. The device as recited in claim 1, wherein said stereoscopically processed composite picture is formed of successive images which together achieve an animation effect as one of said rotary reels is rotated.

5. The device as recited in claim 1, wherein said lenticular sheet is affixed to said composite picture.

6. The device as recited in claim 1, wherein said lenticular sheet is disposed between a display window and at least one of said rotary reels.

7. The device as recited in claim 1 wherein said device is a gaming machine.

8. The device as recited in claim 1, wherein said lenticular sheet is so designed as to have at least such a length that a visual field of said rotary reels through a display window is substantially completely filled by said picture, and a continuous parallax of said stereoscopically processed picture is coincident with a rotational direction of said rotator.

9. A rotary structure body equipped with a rotator having characters arranged on an outer peripheral surface thereof, being characterized by comprising:

a rotator for displaying on an outer peripheral surface thereof at least one stereoscopically-processed character, said stereoscopically-processed character being formed of a stereoscopic image which is obtained by compositing plural images having continuous parallax; and a lenticular sheet, disposed between a display window and said rotator, for stereoscopically displaying said stereoscopically-processed character.

* * * * *